US005301814A

United States Patent [19]

Lower et al.

[11] Patent Number: 5,301,814

[45] Date of Patent: Apr. 12, 1994

[54] INCREASING THE RELATIVE MOTION OF A SCREEN DECK

[75] Inventors: William E. Lower, Cincinnati; Stephen C. Mitchell, West Chester, both of Ohio

[73] Assignee: Rotex, Inc., Cincinnati, Ohio

[21] Appl. No.: 961,430

[22] Filed: Oct. 15, 1992

[51] Int. Cl.[5] ..... B07B 1/34; B07B 1/42

[52] U.S. Cl. ..... 209/326; 209/332; 209/365.4; 209/366; 209/366.5; 198/770; 74/61

[58] Field of Search ..... 209/331, 332, 333, 365.1, 209/325, 326, 365.4, 366, 366.5; 198/760, 761, 763, 767, 770; 74/24, 61

[56] References Cited

U.S. PATENT DOCUMENTS

| | | | |
|---|---|---|---|
| 1,669,094 | 5/1928 | Simpson . | |
| 1,819,665 | 8/1931 | Wiltse . | |
| 2,120,032 | 6/1938 | Mess et al. | 209/332 X |
| 2,358,876 | 9/1944 | Overstrom . | |
| 3,447,638 | 6/1969 | Schilberg . | |
| 3,528,541 | 9/1970 | Barton et al. | 198/760 |
| 3,750,866 | 8/1973 | Musschoot . | |
| 4,121,708 | 10/1978 | Benson et al. . | |
| 4,162,778 | 7/1979 | Kraft | 198/760 X |
| 4,167,478 | 9/1979 | Salete | 209/331 |
| 4,260,051 | 4/1981 | Burghart . | |
| 4,287,056 | 9/1981 | Dumbaugh et al. | 209/332 |
| 4,492,629 | 1/1985 | Dumbaugh | 209/332 |
| 4,694,650 | 9/1987 | Vincent . | |
| 4,813,532 | 3/1989 | Harper . | |
| 4,961,491 | 10/1990 | Falconer . | |
| 5,020,978 | 6/1991 | Nashif . | |
| 5,037,535 | 8/1991 | Bruderlein | 209/332 X |

FOREIGN PATENT DOCUMENTS 0025024 of 1899 United Kingdom .

OTHER PUBLICATIONS

1992 Rotex, Inc. Screener Catalog 209.

*Primary Examiner*—D. Glenn Dayoan
*Assistant Examiner*—Tuan N. Nguyen
*Attorney, Agent, or Firm*—Wood, Herron & Evans

[57] ABSTRACT

The screening efficiency of a gyratory screening machine, of the type having a moving base, is significantly increased by mounting to the base a spring/mass system which is tuned so that operation of the machine drive produces amplified movement of the mass along at least one of two perpendicular axes on which the base moves. Movement of the mass reduces the net force on the base along the axis on which the mass oscillates. The reaction force of the machine drive on the base along the other of the two perpendicular axes may be offset by a rotary counterbalance operated by the drive. Movement of the base relative to the ground is thereby reduced, and movement of the screen deck relative to ground is increased. This both increases the effectiveness of the screening motion and decreases the total reaction force transmitted through the base.

31 Claims, 3 Drawing Sheets

INCREASING THE RELATIVE MOTION OF A SCREEN DECK

FIELD OF THE INVENTION

This invention relates to screening machines of the gyratory type, and more particularly to means for increasing the relative screening movement of a screen deck while reducing the reaction forces transmitted through the base.

BACKGROUND

In a screening machine a drive imparts a screening motion to a screen deck to separate, sift, or classify particles of different sizes, weights, and/or shapes. Typically the drive is mounted to a base and has a moving element, armature, or rotor which is connected to the screen deck to shake, oscillate or gyrate the deck relative to the base.

Some types of screeners have a linear drive, for example an electromagnet, whereby the screen deck is vibrated back and forth in an essentially straight line screening motion.

This invention, however, concerns screeners of the so-called "gyratory" type. In most gyratory screeners the screening motion has different amplitudes at different points on the screen deck, along two perpendicular axes. The motion may for example be circular at one end of the deck but nearly linear at the other end. The deck may be driven by a rotating crank pin at an upper, head, or feed end while the lower, tail, or discharge end is constrained to move in a nearly straight line path. The intermediate part of the deck, near its center of gravity, moves in an elliptical path. Usually but not necessarily the elliptical path of motion of a gyratory screener, measured near the center of gravity of the deck, has an amplitude which is substantially greater in the longitudinal direction than in the lateral (crosswise) direction.

Gyratory screeners are widely used because gyratory motions are considered to offer a distinct advantage in screening, in comparison to either a reciprocating motion or a purely circular motion. The particles are more effectively stratified, rolled over one another and shifted about, which improves the screening efficiency. Moreover, the incoming particles are more uniformly distributed over the screen at the feed end, and the removal of near-size particles at the discharge end is markedly improved.

One well known type of screener having a gyratory motion is sold under the "Rotex" trademark. In "Rotex" gyratory screeners the drive (which is mounted to the base) rotates a crank pin which is journaled in the head end of the screen deck. Rotation of the crank pin by a drive motor imparts a circular motion to the head end. At the discharge end a swing link or "drag arm" is connected to the deck to constrain its movement to a more or less reciprocating or linear motion. The middle portion of the deck moves in an elliptical path in which the component of movement along the longitudinal axis or direction of the deck is substantially greater (for example, about two times greater) than that in the transverse direction.

The drive of a gyratory screener is connected between the base of the machine and the deck, and the force exerted by the drive on the deck creates an equal and opposite reaction force on the base, which tends to oscillate the base oppositely from the deck. If the base is rigidly mounted to a fixed support structure (for example, if the base is bolted to the floor of a building) this oscillating reaction force on the base is imparted directly to the support or building itself, and can set up a powerful vibration in the building. The vibration of the base of a large screener can impart an undesirably large and possibly dangerous vibration to the building housing the screener.

In order to reduce the affect of the base reaction force on the building or other machine support, various means have been used to isolate the base from the support structure. Motor driven counterbalances have been added to linear screeners, see for example Overstrom U.S. Pat. No. 2,358,876. Alternatively, the base might be resiliently supported on shear mounts (such as rubber blocks), or suspended on cables. (Machines having a suspended or shear mounted base are referred to herein as "moving base" machines because the base is not fixed rigidly to a support but rather can move relative to the support.) Such mounts permit the base to move in response to the reaction forces imparted to it by operation of the drive.

If shear mounts are to be used, in order to effectively isolate the motion of a screener from its support structure, the shear mounts should have a natural frequency no more than about ⅓ of the e screener's operating frequency. However, shear mounts are generally so stiff that they do not have a natural frequency within that desired range. (If suitably "soft" shear mounts were chosen to isolate the screener, the resulting system would be statically unacceptable.) Thus, in practice shear mounts do not isolate the screener but rather transmit the unbalanced forces to the underlying support structure. For these reasons shear mounts are typically an ineffective means of attempting to isolate a screener from its support structure.

In contrast, a cable suspension can effectively isolate a screener from its support; and many if not most large capacity gyratory screeners are cable suspended in order to prevent the undesirably powerful base vibrations from being transmitted to the structure housing the screener.

Although mounting the screener base for movement relative to its support can effectively isolate the support from the vibration, as explained above, such movable mounting of the base has an adverse affect on the motion of the screen deck: the relative base movement offsets and reduces the movement of the deck relative to ground or other fixed support structure. As the drive moves the screen in one direction, the reaction force imparted by the drive to the base tends to move the base in the opposite direction, which reduces the net motion of the screen relative to the ground (the "screen-to-ground" relative motion). However, it is the screen-to-ground relative motion which effects particle separation; therefore, base movements which offset screen-to-ground movement reduce the screening efficiency of the machine. In short, the base movement of a moving-base screener (including both cable-hung and shear-mounted screeners) offsets the screening movement and thereby reduces screen efficiency and machine capacity.

Various means have been used to reduce the reaction force of a gyratory drive on the base. So-called "single counterbalance" drives, in which an opposed counterbalance weight rotates with the crank, are used for this purpose. However, a single counterbalance does not eliminate all the reaction force on the base because in a gyratory screener the drive force and the reaction force have different amplitudes along different axes, and a single counterbalance cannot offset the differing motions along both axes. For example, if a single counterbalance is sized to eliminate the longitudinal reaction force acting on the base (usually the larger of the two force components), it will overcompensate for the lateral reaction force and will thereby set up an unbalanced lateral force that itself acts on the base. Relatively small single counterbalance screeners, that is, those having a "swung weight" (the weight of that part of the machine that moves relative to ground) of less than about 800 pounds, can be mounted directly to a "fixed" support without imparting undue vibration to the support structure. However, for gyratory screeners having greater swung weights, the screener is usually cable suspended or otherwise isolated from the support structure in order to isolate the unbalanced force. As already explained, however, when this is done the resulting motion of the base causes an undesirable reduction in screener efficiency.

So called "double counterbalance" drives are also known. Simpson U.S. Pat. No. 1,668,984 teaches a gyratory screener having two counter-rotating counterbalance weights operated by the drive. Because of the counter-rotation, twice every revolution the weights move through the same angular position, at which their generated forces are additive; and twice every revolution they pass through positions that are diametrically opposite, at which their generated forces are subtractive. If the counterbalances are positioned so that their forces add along the longitudinal axis and subtract along the lateral axis, they can be sized so that the additive force is substantially equal to the longitudinal out-of-balance force and the difference between their forces is substantially equal to the lateral out-of-balance force.

In a relatively small screener, a double counterbalance drive can reduce base vibration sufficiently that the base can be safely bolted directly to the floor. However, even with a double counterbalance a large screener is usually cable hung in order to isolate the base movement from a building structure. Even a double counterbalance drive cannot neutralize the base reaction forces in a gyratory screener as effectively as is desired. The gyratory motion has some force components that are not fully offset, especially at the lower end of the deck. As a result, the base of a suspended conventional screener still has an undesirable vibration relative to a fixed surface. By way of example, the drive crank of a Rotex Series 70 screener moves the deck, adjacent the pin journal, in a circle of about 3.5" diameter. Even with a double counterbalance, the base of a cable hung screener, measured at the head end, moves in a loop path having x-y dimensions of about 0.31–0.38". Since this base motion is 180° out-of-phase with the deck motion, it reduces the screen motion from about 3.5" to as little as about 3.12", a loss of almost 11% of the stroke. Even though cable mounting the base prevents this base movement from being transmitted to the building, screening efficiency is nevertheless significantly reduced. (Increasing the amplitude of the movement imparted to the screen deck by the drive would improve the screening motion, but is not practical because it would be more costly and would increase the out-of-balance forces acting on the base.)

On a given machine a double counterbalance does not entirely eliminate the motion of a movable base, but it reduces deck movement less than a single counterbalance would. It is thus desirable to use a double counterbalance drive on larger moving use a double counterbalance drive on larger moving base machines. However, the cost of a double counterbalance drive is substantially greater than that of a single counterbalance. Furthermore, double counterbalancing requires an additional set of gears and bearings, adds complexity, and requires additional lubrication and maintenance.

Thus, a substantial need has existed to minimize the base movement of both single and double counterbalanced gyratory screeners of the movable base type, in order to increase the relative movement of the deck and thereby improve the efficiency.

SUMMARY OF THE INVENTION

In accordance with this invention, the force transmitted through the moving base of a gyratory screener is opposed and substantially offset by a passively driven base force reducer having a weight which is spring mounted on the base for vibratory movement relative to the base along at least one of two mutually perpendicular axes of base movement. It has been found critical that the magnitude of the weight and the spring constant of its mounting springs be selected to produce a natural frequency that is near, although preferably not precisely equal, to the operating frequency of the drive. It has been found completely ineffective for the force reducer to operate at the natural frequency of the suspended screener.

When the drive is operating, the weight oscillates 180° out of phase with the base motion. Because the force generated by the reducer acts on the base in the opposite direction from the reaction force of the drive, it substantially reduces the out of balance force acting on the base. When the invention is used, the base moves remarkably little relative to the ground. Indeed, the base-to-ground movement is greatly reduced even with a single counterbalance screener. As a result, the screening movement (the movement of the screen deck relative to ground) is substantially increased.

Improved screener performance can be achieved by using the invention on both single and double counterbalance screeners. Importantly, because the motion of and force transmitted through the base are reduced so dramatically, large screeners can be safely mounted to the floor by shear mounts; cable hanging is no longer necessary to isolate the housing structure from base vibration.

In preferred form, the base force reducer comprises a weight (mass) which is spring-mounted transversely to the base so that it can oscillate or vibrate in the crosswise direction on the base. A single rotary counterbalance is sized to offset the vibration along the longitudinal axis. The weight may be a stack of steel plates, and is preferably mounted below the base at the head (drive) end by vertical springs. The springs are preferably leaf springs made of fiberglass; they elastically permit the weight to move in the transverse direction while resisting motion in the longitudinal direction.

If, as is preferred, a single rotary counterbalance is used and is sized to balance the reaction force of the deck along the longitudinal axis of the deck, it then overbalances the reaction force along the lateral axis (the smaller of the two vectorial components of the reaction force). The force reducer is preferably sized to minimize the excess force along the lateral axis due to the rotary counterbalance.

The spring constant and mass of the force reducer are determined in accordance with the equation, $$\text{natural frequency} = \frac{1}{2\pi}\sqrt{\frac{\text{spring constant}}{\text{mass}}} \text{ cycles/sec}$$

It is important that the force reducer be selected or sized with reference to the operating frequency of the screen drive, not the natural frequency of the suspended screener. (The screener's operating frequency and natural frequency are usually quite different. For a cable-hung Rotex Series 70 screener, for example, the natural frequency is less than 60 rpm, whereas the operating frequency is about 200 rpm.) It has been found that if the force reducer were sized to resonate at the natural frequency of a cable suspended screener, it would have very little force reducing effect. However, if the force reducer is sized to resonate near to the operating frequency of the screener, it surprisingly and dramatically reduces the motion of the screen base. Moreover, the use of such a reducer obviates the added expense and complexity of a double counterbalance drive by making it possible to use a single counterbalance sized to offset base reaction movement in the longitudinal direction.

Preferably the natural frequency of the force reducer should be in the range of about 80–120% of the screen drive operating frequency; more preferably the natural frequency of the force reducer should be about 80–95% or 105–120% of the screen drive operating frequency, rather than precisely at the screener operating frequency. Most preferably, the force reducer should be sized to resonate just above the operating frequency, i.e., about 105–120% of screener operating frequency.

The force reducer is preferably mounted in front of (toward the head end from) the center of gravity of the base. As a practical matter, at least for Rotex gyratory type machines, it is preferred to mount the force reducer directly below the drive. This facilitates mounting and access, reduces floor space requirements in comparison to an outboard mounting, and protects and shields the reducer. Preferably a single force reducer is used, rather than two or more smaller reducers mounted at spaced positions. Analysis has demonstrated that providing two smaller reducers, at the head and tail ends respectively, would be far less effective than a single larger reducer at the head end.

It should be recognized, at least as a practical matter, that the motion of the base probably cannot be totally eliminated: some small residual movement will probably remain. It is believed that this is because the gyratory screening movement usually includes a slight twisting about a vertical axis due to the tail end constraint (for example by a drag link) which is uncompensated. Nevertheless, the invention effects an improvement which is reflected as a very significant increase in screening motion that in turn results in increased screening efficiency.

DESCRIPTION OF THE DRAWINGS

The invention can best be described by reference to the accompanying drawings, in which.

DETAILED DESCRIPTION

Figure 1:
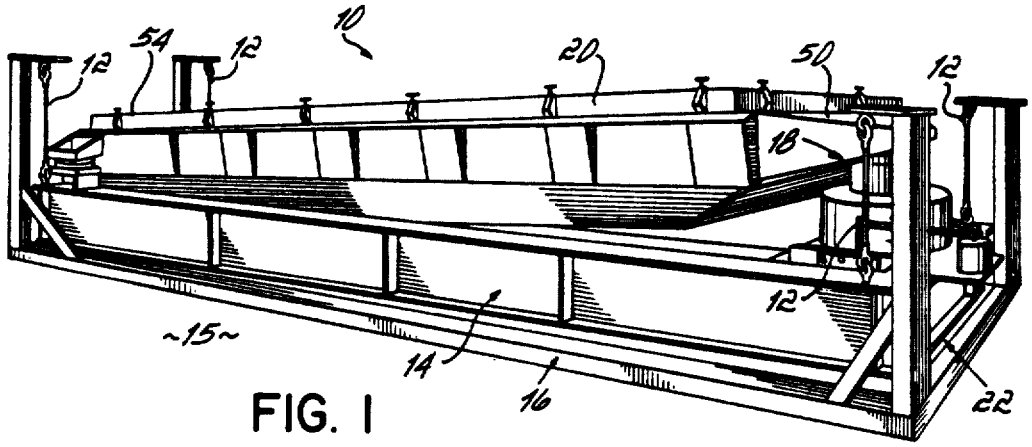
FIG. 1 is a perspective view of a cable-hung gyratory screener having a base force reducer in accordance with a preferred embodiment of the invention.
Figure 3:
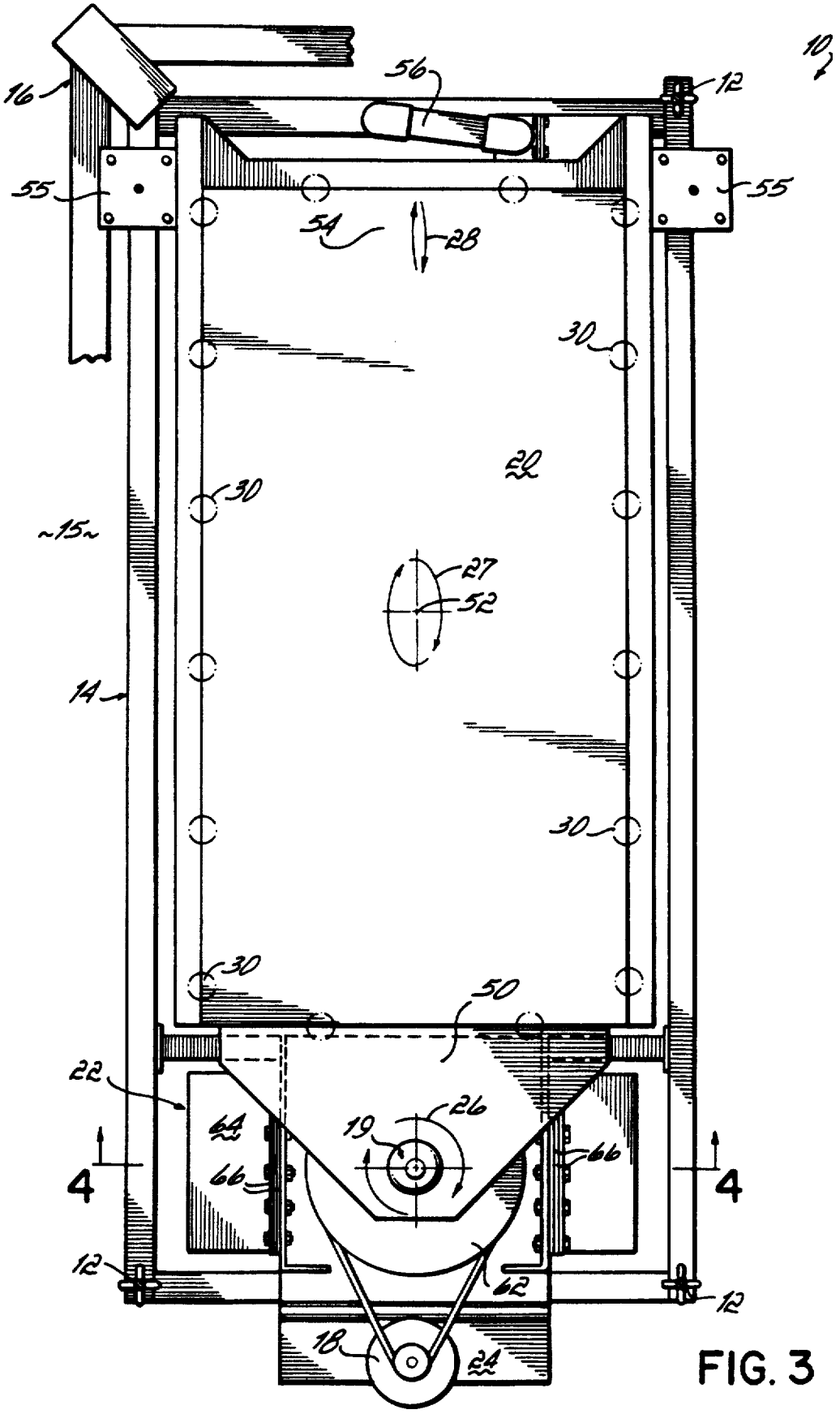
FIG. 3 is a top plan view, partly diagrammatic, of the screener of FIG. 1.

Referring to FIG. 1 of the drawings, a gyratory screener 10 has a frame-like base 14 which is suspended on four cables 12 from an external support 16. The support 16 is fixed to "ground" 15 which may be the floor of a housing building or other support structure, not shown. A drive motor 18 is mounted on base 14 and rotates a crank pin 19 (FIG. 3) which is journaled in the head end of a screen deck or box 20 of screener 10. A removable screen (not shown) is mounted in deck 20 by clamps 30.

Drive motor 18 imparts a gyratory motion to screen deck 20. The head end 50 of the deck, adjacent the crank pin 19, is moved in a circular path 26 shown diagrammatically in enlarged form (FIG. 3) relative to screener base 14. The lower or tail end 54 of deck 20 is supported on a slide plate 55 at each corner and is connected to base 14 through a rocker or drag arm 56, which establishes a narrowly elliptical motion as designated by ellipse 28. (Alternatively, the tail end 54 of the deck may be supported on leaf springs, not shown. This establishes a more linear motion and eliminates the maintenance and wear associated with slide plates and a drag arm.)

As can be seen, the motion of points on the screen becomes increasingly elliptical between head end 50 and tail end 54. For example, in a Rotex Series 70 gyratory screener, the motion of the screen deck is a circle 26 of about 3.5" diameter at the head end; adjacent the center of gravity 52 it is an ellipse 27 having a major axis of 3.5" and a minor axis of 1.75"; and at the tail end it is a narrow ellipse 28 with a major axis of 3.5" and a minor axis of only 0.13". This cyclical motion has two components, a longitudinal component (parallel to the long axis of the base) and a differing lateral component. It is this motion of deck 20 which produces the desired gyratory screening effect.

The screener as thus far described in detail may be of the well known "Rotex" type and therefore is not described in further detail.

As a consequence of the drive's imparting motion to deck 20, it imposes a reaction force on base 14. In accordance with a presently preferred embodiment of the invention, the screener drive has a single rotary counterbalance 62 which offsets part of the reaction force. The counterbalance weight 63 is sized to produce a force on the rotating drive shaft 58 in the direction of the longitudinal axis of deck 20 which is substantially equal to the force acting on the shaft on that axis due to the force of the screen deck 20, but opposite in direction. However, because the deck motion is elliptical whereas the magnitude of the counterbalance force remains constant, the counterbalance force exceeds the lateral reaction force on the base and in effect overcompensates for that force.

Figure 4:
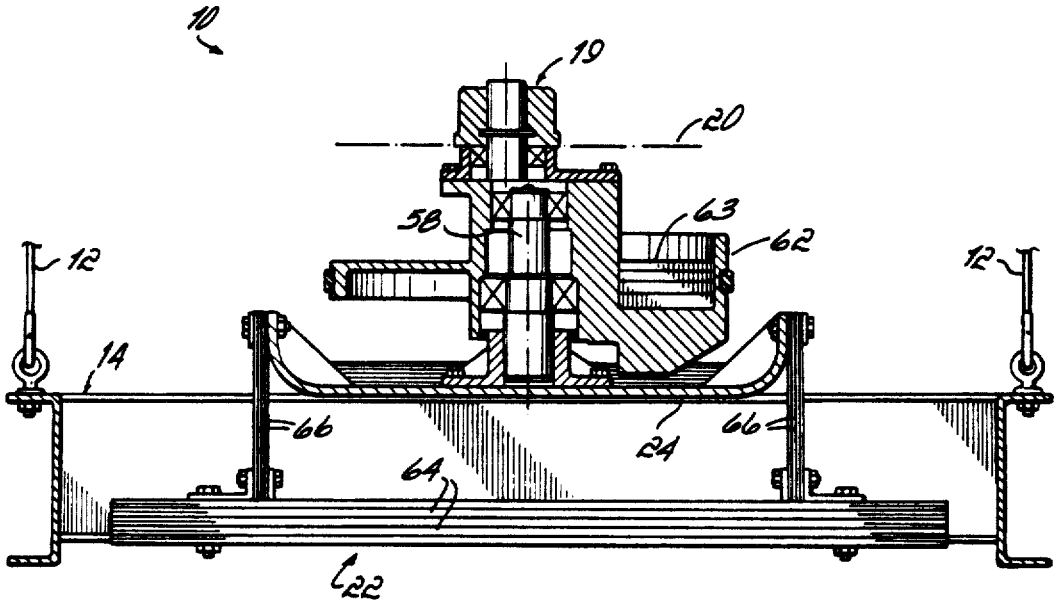
FIG. 4 is a vertical cross section taken along line 4—4 of FIG. 3.

To compensate for the lateral force acting on the base from the rotary counterbalance, a force reducer 22 is provided. On the base, reducer 22 is preferably suspended directly from the drive mounting 24, as shown in FIG. 4, and includes a mass (weight) 64 mounted by one or more springs 66 for movement on the base in the lateral direction. By tuning the force reducer to resonate at a frequency near to or at the operating frequency of the screener, the movement of the reducer is amplified when the screener is running at its operating speed. The amplitude of reducer movement exceeds that of the base; as a result, the reaction force of the reducer 22 on base 14 exceeds the force transmitted from the base. Therefore, the reducer 22 reduces the total force acting on the base by the amount that the reducer reaction force exceeds the input force.

As indicated above, it has been found most preferable that the force reducer 22 have a natural frequency which is near to but not exactly equal to the operating frequency of the screener 10. Although a reducer resonating at the screener operating frequency might theoretically seem to provide the optimal result, tuning the reducer to that frequency is undesirable because the amplified movement of the mass would usually be too great. The reducer is only lightly damped, in its preferred form; and if a lightly damped system is excited at its natural frequency, then the amplitude response of that system when resonated could be so large as to be destructive or to exceed the elastic limit of the springs. Although it might be possible to design a force reducer to operate precisely at the screener operating frequency, as by adding damping to the force reducer system, to do so would not usually be practical. Primarily, adding damping to the system will reduce its effectiveness. In addition, adding damping would likely increase the complexity and cost of the system. Finally, the normal by-product of increased damping is increased heat generation which may impact upon the screener's operation or necessitate the use of cooling equipment.

In any case, the natural frequency of the force reducer should be selected such that the operating frequency lies within the force reducer's amplified range, that is, the frequency range in which the movement of the mass relative the base exceeds that of the base relative to the support structure. The closer the natural frequency of the force reducer is to the screener operating frequency, the more pronounced this amplification becomes. A point could be reached at which the response of the force reducer would exceed the elastic limits of the spring, and thereby could damage itself. Thus, it is preferable to use a lightly damped force reducer tuned such that it is operated within the amplified range, but not to the point of damage or destruction. It has been found that by selecting the natural frequency of the force reducer to be close to, e.g., within about ±5-20% of the screener operating frequency and most preferably above the operating frequency of the screener, a balance between the competing concerns is obtained. Tuning to a frequency above the drive operating frequency insures that the reducer is not resonated either in operation or in start-up; its resonating frequency is approached but is not reached. (If the reducer were tuned to a frequency slightly below the operating frequency, it would pass through its resonant frequency during start up which could cause excessive shaking and/or possible damage.) In practice, the optimal tuned frequency depends on the nature of the springs, the damping rate, the space available for reducer oscillation, and whether there is a component of vertical motion. For a given tuner, the most practical tuned frequency can be found by a series of comparison tests. For a Rotex Series 50 machine operating at 200 rpm, tuning the force reducer to about 228 rpm (14% greater than operating frequency) has been found to be satisfactory.

As an alternative to tuning above or below the operating frequency, damping can be added to the system; increasing the damping associated with the force reducer decreases its response to the input force. However, increasing the damping would likely result in increased heat generation, which is undesirable; and the increased complexity or wear of the system is also counterproductive. So long as the operating frequency of the screener 10 lies within the amplified range of the force reducer movement, the reaction force produced by the reducer on the base 14 will exceed the excitation force, and will thereby reduce the net force acting on the base and correspondingly increase the relative motion of the screen deck 20 to a fixed point.

Figure 6:
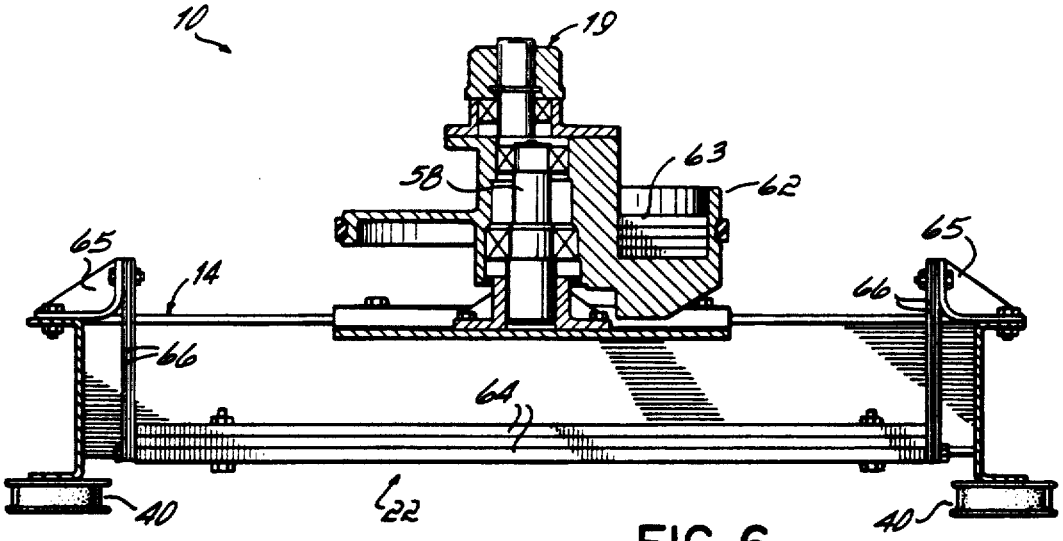
FIG. 6 is a vertical section similar to FIG. 4 but shows a shear mounted screener with an alternative reducer mount wherein the reducer is suspended directly from the base.

Reducer mass 64 is simply a dense material; preferably one or more plates of steel 64 are used by reason of low cost, ease of fabrication, and ease of adjusting the amount of weight. These plates are bolted or otherwise connected together to act as a unitary mass. In turn, this mass 64 is suspended from the screener base by the springs 66. Although the springs may be attached to the base at any point, the preferred location for attachment is directly to the drive mounting 24 as shown in FIG. 4, or directly to the base 14 adjacent to the drive motor mounting as designated by 65 in FIG. 6.

Springs 66 are preferably leaf springs. They have the advantage of being easily connectable to both the mass and the screener base as well as requiring a minimum of parts. The leaf springs 66 can be of a resilient material which is able to support the mass and sustain the necessary motion of the mass. It has been found that fiberglass leaf springs are especially advantageous; they are highly elastic, flexible, durable, and relatively inexpensive. Preferably the lower ends of the leaf springs are bolted to the mass 64, and the upper ends to the base 14 as at mountings 24 or 65. The force reducer has few parts and requires little or no attention or maintenance.

In the preferred configuration mass 64 is constrained to oscillate only in a single direction (most preferably the lateral direction), but it is contemplated that the mass could alternatively be mounted to oscillate in two perpendicular directions of base movement. For example, the mass could be supported on rollers to roll on a support, with coil springs or shear mounts attaching the mass to the base.

In selecting the size of the mass 64 and the stiffness of springs 66, several factors are to be considered. For a specific spring, such as a fiberglass leaf spring, the spring constant is a known factor which the manufacturer can usually supply. Its stiffness depends on the number of plies (layers) used, as well as the length, width and thickness of each ply.

As an example of the calculation of the spring constant, the force reducer used with a single counterbalance test screener had a weight of 1512 pounds. The spring constant was determined by following the equation:

$$k = m(2\pi f)^2$$

The desired frequency, f, of the force reducer was 220 rpm (3.66 HZ), slightly above the screener operating frequency 200 rpm. By inserting the specific values in the formula, the required spring constant was obtained:

$$k=(1512/386.4)[2\pi\times 3.66)]^2=2069 \text{ pounds/inch}$$

(the term 386.4 is used to convert weight to mass). Given this desired spring constant, the length, width, thickness and number of plies of fiberglass was chosen.

The results of using the force reducer are dramatic. By way of example, a cable suspended test screener with no force reducer but having a single rotary counterbalance at the head end, sized to offset the longitudinal vibration, had a lateral base-to-ground peak-to-peak motion, measured at a point adjacent the crank, of about 0.75". By adding a force reducer in accordance with the invention, the base movement was reduced to an amplitude of only about 0.08", about an 89% reduction. An additional surprising effect was the reduction in motion of the tail end of the screen deck due to the reducer. Tail motion was reduced from 0.375" to 0.07". Due to this reduction in base motion relative to the screen, the screening efficiency was significantly improved.

In the example above, the mass 64 oscillated with an amplitude of 0.65", or a total of 1.3" in the lateral direction. The lateral motion of the mass thus substantially exceeded the uncompensated motion of the base. This occurred because the force reducer was operating in its amplified range. This motion of the force reducer mass must be considered when locating the force reducer, in order to prevent interference with the other parts of the screening machine. By varying the force reducer mass and/or spring constant, the motion of the force reducer can be altered: increasing the mass will decrease the motion, while decreasing the mass will increase the motion. Force reducers of different masses were tested, having masses from about 10% of the mass of the machine up to about 30% of the mass of the machine. It was found that in order to obtain desirable force reduction while at the same time keeping the motion of the force reducer within acceptable limits, a force reducer mass of about 10–30% of the machine mass is preferred. At smaller masses, the motion of the mass would be impractical or excessive (for example, greater than 3" end-to-end) and could result in over-stressing the springs. At greater masses, the cost and size of the force reducer tend to become impractical.

Although in the preferred embodiment the reducer 22 is mounted directly beneath the drive mounting 24, in actual practice it may be mounted anywhere in front of the screener center of gravity 52. Mounting the reducer beneath the drive mount is advantageous because the screener occupies less space and the system is safer because the oscillating system is shielded from contact.

Figure 5:
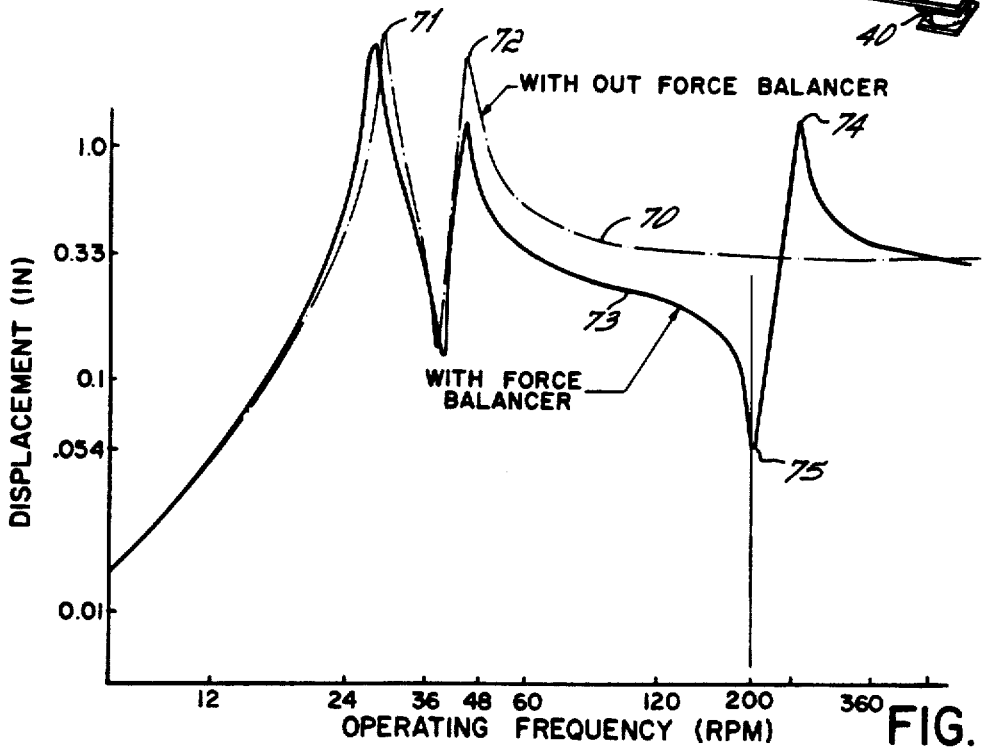
FIG. 5 is a graph illustrating the calculated effect of a reducer on the displacement of the base of a gyratory screener, over a range of operating frequencies.

FIG. 5 graphically depicts the mathematically modelled relationship between the operating frequency of the screener and the amplitude of base movement, for a specific, cable-hung, single counterbalance screener. The broken line 70 shows the displacement of the base as a function of frequency, without a force reducer. The two peaks 71, 72 at 27 and 44 rpm, represent the first two natural frequencies of the screener (i.e., swinging and twisting of the screener on the cables). At the 200 rpm operating frequency of the screener, the head end of the base is calculated to move in a circle of about 0.66" dia. relative to ground.

When the reducer is added, two things happen, as shown by the calculated solid line 73 for the modified system. An additional peak 74 appears at 240 rpm. This is due to the addition of another resonant frequency to the entire system. At that frequency, both the screener and the reducer would experience large deflections. However, this response occurs above the operating frequency and is not encountered. Second, and more importantly, an amplitude "trough" 75 is produced at the 200 rpm operating frequency of the screener. As a result, the base motion at the operating frequency is reduced to only ±0.054". This trough in the displacement of the base at the operating frequency is due to the fact that the reducer resonates at that frequency. (The graph does not take into account the undesirability of excessive reducer movement if tuned to the operating frequency.) As a result, most of the energy being placed into the screener base at the operating frequency is dissipated by the reducer. (However, as explained above, movement of the reducer could be undesirably great at that frequency, so it is tuned to a frequency on the trough at which reducer movement, while amplified, is not dangerous.)

In the presently preferred practice of the invention, the reducer is used to offset the drive reaction along the lateral axis, and a single rotary counterbalance is used to offset force along the longitudinal axis. However, that relationship could be reversed, that is, a force reducer can alternatively be used to offset the drive reaction force along the longitudinal axis, and rotary counterbalancing to offset the transverse force. This is less desirable because a force reducer vibrating in the longitudinal direction has been found unable to reduce the tail end motion of the base as effectively as a force reducer which vibrates in the lateral direction. Further, depending on the specific screener, the invention also contemplates using two linear mass-spring reducers, oriented in perpendicular directions, or a single reducer mounted for movement both laterally and longitudinally. By doing so, use of a rotary counterbalance could be eliminated altogether. However, because a single rotary counterbalance requires few additional components, it will usually be less expensive in practice to use a single rotary counterbalance than to replace it with a second force reducer.

Figure 2:
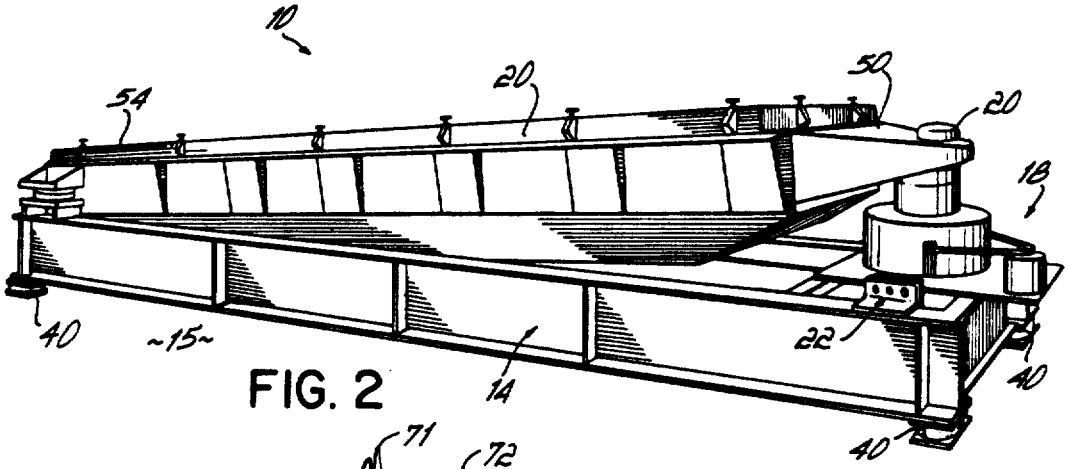
FIG. 2 is a perspective view of a shear mounted, moving base gyratory screener having a force reducer in accordance with a modified form of the invention.

In the modified embodiment of the invention shown in FIG. 2, instead of cable mounting, the base of screener 10 is movably mounted directly to ground 15, as by resilient elastic shear mounts 40. Like cable suspension, the shear mounts help to isolate the support or floor 15 from the vibration of the machine. Because shear mounts are relatively stiff, they are ordinarily unable to adequately isolate the low frequency motion of the base. With the invention, however, the base vibration is substantially reduced and the movement of the shear mounts is so small that they can now effectively be used.

Having described the invention, what is claimed is:

1. A positive displacement gyratory screening machine, comprising a screen deck;

a base movably mounted to a fixed support structure, said base being mounted for movement relative to said fixed support during operation of said machine;

a drive attached to said base and connected to said screen deck to impart a gyratory screening motion to the deck at an operating frequency, and a force reducer comprising a mass which is mounted by a spring to said movable base for oscillation in at least one of the directions in which said drive gyrates said deck, said force reducer being tuned to resonate at a frequency which is substantially equal to or close to the operating frequency of said drive, oscillation of said force reduce dissipating forces of said drive acting through said base, reducing the motion of said movable base relative to said support structure, and increasing the motion of said screen deck relative to said support structure, said machine displaying substantially greater deck-to-deck support movement in comparison to an otherwise similar machine without said force reducer.

2. The gyratory screening machine of claim 1, wherein said force reducer has a natural frequency such that, when said machine is operated at said operating frequency, said force reducer has an amplitude of movement which is greater than the movement of said base in said one direction.

3. The gyratory screening machine of claim 2 wherein said natural frequency is within the range of about 80–120% of said operating frequency.

4. The gyratory screening machine of claim 2 wherein said natural frequency is within the range of about 80–95 or 105–120% of said operating frequency.

5. The gyratory screening machine of claim 2, wherein said natural frequency is greater than said operating frequency.

6. The gyratory screening machine of claim 2 wherein said natural frequency is within the range of about 105–120% of said operating frequency.

7. The gyratory screening machine of claim 1, wherein said force reducer oscillates in only one of said directions and said drive includes a rotating counterbalance sized to offset said forces acting on said base in the other said direction.

8. The gyratory screening machine of claim 7, wherein said spring of said force reducer comprises a leaf spring.

9. The gyratory screening machine of claim 8, wherein said leaf spring comprises a plurality of fiberglass sheets connected together.

10. The gyratory screening machine of claim 8, wherein said mass of said force reducer comprises at least one plate connected to said leaf spring.

11. The gyratory screening machine of claim 7, wherein said force reducer oscillates in a lateral direction and said counterbalance offsets forces of said drive in a longitudinal direction.

12. The gyratory screening machine of claim 1, wherein said force reducer is attached to said base forward of the center of gravity of said gyratory screening machine.

13. The gyratory screening machine of claim 1, wherein said force reducer is attached to said drive beneath said drive, said drive being attached to said base.

14. The gyratory screening machine of claim 1, wherein said force reducer is attached directly to said base, beneath said drive.

15. The gyratory screening machine of claim 1, wherein said base is movably suspended from a fixed support structure by a plurality of cables.

16. The gyratory screening machine of claim 1, wherein said base is movably mounted to said fixed support structure by a plurality of shear mounts.

17. The gyratory screening machine of claim 1, wherein said drive moves said deck in a circular motion adjacent said drive and in an elliptical motion at a end of said deck which is removed from drive.

18. The gyratory screening machine of claim 1, wherein said mass of said force reducer is between about 10% and about 30% of the mass of said machine.

19. The gyratory screening machine of claim 2, wherein said mass of said force reducer is selected so that the movement of said force reducer does not exceed the elastic limits of said spring.

20. The gyratory screening machine of claim 1 wherein said deck has a longitudinal axis and said force reducer is mounted to said base for oscillation in a direction transverse to said longitudinal axis.

21. The gyratory screening machine of claim 20 wherein said force reducer is mounted to said base by means which prevent it from oscillating in a direction parallel to said longitudinal axis.

22. A positive displacement gyratory screening machine comprising a base, said base being mounted to a fixed support for movement relative thereto during operation of said machine;

a screen deck, a rotary drive mounted on the base and connected to said deck to drive a portion of said screen deck in a gyratory screening motion relative to said base, said screening motion having amplitudes of different magnitude along two mutually perpendicular axes, said drive when operated at an operating frequency imparting reaction forces to said base which move said base relative to said fixed support in directions opposite to the movement of said deck thereby reducing the movement of said deck relative to said fixed support, a mass mounted to said base by a spring, said mass being oscillatable relative to said base along at least one of said two axes, said spring and mass being sized to have a natural frequency which is substantially at or near to said operating frequency of said drive, and a rotary counterbalance operated by said drive, said counterbalance being sized to impart a force to said base which substantially offsets the force of said drive on said base along one of said two axes.

23. A method of increasing the absolute motion of a screen deck of a positive displacement gyratory screening machine having a base which moves during operation thereof, by decreasing the motion of said movable base of said machine relative to a fixed point when said machine is driven at an operating frequency, said method comprising, providing a force reducer having a spring mounted mass which has a natural frequency substantially at or near to said operating frequency, mounting said force reducer to said movable base of said machine so that said mass can oscillate in a direction in which said deck moves, and operating said machine by applying a gyratory screening movement to said deck from a drive mounted to said movable base and operating at said operating frequency, such operation oscillating said mass and producing a reaction force on the base which opposes reaction movement of said base and thereby reduces the motion of said movable base relative to said fixed point, the reduction in reaction movement of said base increasing the motion of said deck.

24. The method of claim 23 wherein said force reducer is provided with a natural frequency near said operating frequency, at which the amplitude of oscillation of said mass is greater than the amplitude of oscillation of said base but not so much as to damage said base or spring.

25. The method of claim 23, wherein said force reducer is provided with a natural frequency which is about 80–120% of said operating frequency.

26. The method of claim 23 wherein said force reducer is provided with a natural frequency which is about 80–95% or 105–125% of said operating frequency.

27. The method of claim 23, wherein said force reducer is provided with a natural frequency which is about 105–125% of said operating frequency.

28. The method of claim 23, wherein said mass oscillates along a first axis of movement of said deck and said drive includes a rotating counterbalance which is sized to offset said forces acting on said base along a second axis which is perpendicular to said first axis.

29. The method of claim 23, wherein said force reducer oscillates in a lateral direction and said counterbalance offsets said forces acting in a longitudinal direction.

30. The method of claim 23, wherein said counterbalance is a single counterbalance.

31. The method of increasing the motion, relative to a fixed point, of a screen deck of a positive displacement gyratory screening machine of the type having a base which moves relative to said fixed point during operation, by reducing the motion of said base of said machine relative to said fixed point, said method comprising, providing a oscillatable force reducer having a spring mounted mass, said force reducer having a natural frequency which is slightly above a frequency at which said screener machine is operated and at which said force reducer oscillates with an amplified motion as compared to the motion of said base;

mounting said force reducer to the base of said machine to oscillate thereon in at least one direction in which said base moves relative to said fixed point, and operating said machine at said operating frequency;

oscillation of said mass dissipating reaction forces acting on said base in the direction of oscillation of said mass and reducing said motion of said base relative to said fixed point.

* * * * *